US006043421A

United States Patent [19]

Adams

[11] Patent Number: 6,043,421

[45] Date of Patent: Mar. 28, 2000

[54] DEVICE, HAVING A MULTI-PART PIVOTING LINKAGE, FOR SETTING THE TENSION OF A KETTLEDRUM SKIN

[75] Inventor: A. A. J. Adams, CA Thorn, Netherlands

[73] Assignee: Adams Paukenfabriek B.V., Netherlands

[21] Appl. No.: 09/186,458

[22] Filed: Nov. 5, 1998

Related U.S. Application Data

[60] Provisional application No. 60/064,661, Nov. 6, 1997.

[30] Foreign Application Priority Data

Nov. 6, 1997 [NL] Netherlands ..... 1007471

[51] Int. Cl.[7] ..... G10D 13/04

[52] U.S. Cl. ..... 84/419

[58] Field of Search ..... 84/413, 419, 421, 84/411 R, 422.1

[56] References Cited

U.S. PATENT DOCUMENTS

| | | | |
|---|---|---|---|
| 1,561,790 | 11/1925 | Ludwig et al. | 84/419 |
| 2,261,119 | 11/1941 | Ludwig et al. | 84/421 |
| 3,163,075 | 12/1964 | Tperzer, Jr. | 84/419 |
| 3,685,389 | 8/1972 | Bemben | 84/411 |
| 3,701,834 | 10/1972 | Rubio | 84/419 |
| 3,747,463 | 7/1973 | Hinger | 84/419 |
| 4,122,748 | 10/1978 | May | 84/411 A |
| 4,211,143 | 7/1980 | Cote | 84/402 |
| 4,228,721 | 10/1980 | Hancox | 84/411 R |
| 4,278,003 | 7/1981 | Hanson | 84/411 A |
| 4,635,524 | 1/1987 | Allen et al. | 84/419 |
| 4,667,562 | 5/1987 | Lee | 84/422 R |
| 4,709,613 | 12/1987 | Powers et al. | 84/413 |
| 4,831,912 | 5/1989 | Allen et al. | 84/419 |

FOREIGN PATENT DOCUMENTS

| | | |
|---|---|---|
| 1024321 | 2/1958 | Germany . |
| 3045576 | 6/1981 | Germany . |

*Primary Examiner*—Robert E. Nappi
*Assistant Examiner*—Wesley Scott Ashton
*Attorney, Agent, or Firm*—Michaelson & Wallace; Peter L. Michaelson

[57] ABSTRACT

A device for setting the tension of a skin, particularly one used in a musical instrument, such as a kettledrum. The device includes a freely-suspended multi-part linkage for vertically displacing a tensioning star, wherein the linkage has two parts connected through a pivot. Each of these link parts has first and second ends, where the first and second ends of the first and second link parts respectively form first and second ends of the entire linkage. The pivot lies inward on the first and second link parts of the second and first ends of the first and second link parts, respectively. Furthermore, the second link part bears, at a first predefined location thereon, such as proximate the second end thereof and via a contact face located thereat, against an adjustment cam. A coupling pin is connected to the second link part at a second predefined location intermediate the point where the pivot is connected to this link part and the first predefined location. The coupling pin, in turn, is connected to and vertically moves the tensioning star to increase or decrease the tension of the skin based on direction and distance through which the pin moves. Through vertical movement of adjusting end, the tensioning star is vertically moved in such a manner that tension is evenly imparted to the skin, which, in turn, reduces objectionable vibrations produced by the instrument and hence improves its tonal quality.

10 Claims, 3 Drawing Sheets

DEVICE, HAVING A MULTI-PART PIVOTING LINKAGE, FOR SETTING THE TENSION OF A KETTLEDRUM SKIN

CROSS-REFERENCE TO RELATED APPLICATION

I claim priority of my U.S. provisional patent application Ser. No. 06/064,661, filed Nov. 6, 1997, which is expressly incorporated by reference herein.

FIELD OF THE INVENTION

The invention relates to a device for setting the tension of a skin, in particular for use in a musical instrument such as a kettledrum.

BACKGROUND OF THE INVENTION

Such a device is known from practice and is, for instance, supplied by the firm Adams Paukenfabriek B. V., Thorn, the Netherlands.

The known device comprises a single unitary link, which, at a first side is provided with a pivot point and at an opposite, second side is provided with engagement means for an operating member, while between the first and the second end thereof coupling means are provided in the form of a pin having screw thread, for coupling the connecting means to the skin. The link is suspended in the first pivot point, with the coupling means being provided at a distance from the pivot point. During use, the coupling pin extends approximately vertically and is pulled in upward direction under the influence of the tension of the skin. Energization of the operating means causes the link to pivot around the pivot point, so that the coupling means are pressed downwards. This increases the tension of the skin, as a result of which, for instance, the pitch of the instrument is raised. Moreover, the pitch can be influenced by adjusting the pivot point in vertical direction, in such a manner that the link will pivot approximately about the engagement means for the operating member, which also brings about a movement in vertical direction of the coupling means.

The drawback of this known device is that a relatively large force is required for displacing the coupling means, in particular in the case of relatively high tension of the skin. This is disadvantageous, since it adversely affects the ease with which the instrument can be used. Moreover, due to the high forces that occur, the frame of the instrument is subject to a high load. In addition, there is the drawback that when the instrument is played, the skin will be displaced relative to the frame, in a direction other than intended for setting the tension of the skin. A further drawback of this known device is that due to the high forces that occur, distributed unevenly over the frame, different vibrations will occur in different parts of the frame, which adversely affects the resulting tones produced by the instrument, in particular in the high registers, in respect of both tonal purity and the duration of the tone.

SUMMARY OF THE INVENTION

The object of the invention is to provide a device of the type mentioned above, in which the above-described drawbacks are avoided and the advantages thereof are retained. In particular, the object of the present invention is to provide a device for setting the tension of a skin of a kettledrum or a like musical instrument, which device can be operated in a simple and ergonomically sound manner, while the sound of the musical instrument is further improved.

Specifically, in accordance with the present invention, dividing the link (also referred to herein as a "composite link") into two link parts, which link parts are pivotally interconnected, offers the advantage that a more even distribution of the occurring forces over the frame of an instrument can be realized, while, moreover, the forces occurring in the first pivot point are reduced considerably. When the operating means are energized, the second link part will pivot relative to the first link part, while the position of the latter will hardly change. This will involve vertical movement of the coupling means with the second link part, thereby setting the tension of the skin. It also applies that upon adjustment of the first pivot point in vertical direction, the first link part will pivot relative to the second link part, while due to the coupling between the first and the second link parts, the coupling means will likewise be moved in the vertical direction, which again influences the tension in the skin. In this regard, the divided link offers the advantage of providing a favorable transmission ratio for both manners of adjusting the coupling means, as a result of which the operation requires relatively little force.

Due to the even forces that occur, an even load on the parts of the instrument, in particular the frame parts thereof, is obtained, so that no objectionable differences in vibrations will occur. Moreover, a particularly even distribution of forces on the skin is thereby obtained and maintained, so that no undesired displacements of the skin will occur. This produces an instrument which can be operated in a particularly suitable and simple manner and which has a particularly nice sound.

Furthermore the first link part is advantageously provided with support means spaced from the first and second ends of the composite link. Consequently during pivoting of the first and/or second link part, the first link part can receive support from a frame part of the instrument. The support means will serve as pivot point for pivotal movement of the first link part during vertical displacement of the first end of the sink, while the support means will moreover act as support point during pivotal movement of the second link part relative to the first link part. This ensures even more effectively that the first link part will at least substantially remain in the starting position, thus further ensuring that during operation of the operating member, and hence pivotal movement of the second link part, the position of the pivot point adjacent the first end of the link is not influenced. Moreover, these support means offer the advantage that movements of the first link part can readily be transmitted to the coupling means, while a favorable force ratio is realized between the force required for a vertical adjustment of the pivot point and the changing tension of the skin.

Preferably, the support means are arranged so as to be situated next to, at least adjacent, the coupling means, approximately halfway between the first end and the second end of the link. As a result, the forces which, during use, are transmitted by the support means to a frame of the instrument, are distributed over the frame in a favorable manner, which is advantageous with regard to vibrations occurring in the frame. Moreover, undesired deformations of frame parts and the like are thus prevented.

Additionally, the use of bearing means with the support means yields the advantage that forces can be transmitted by the support means in substantially only one direction, in particular at right angles to the plane of the frame part from which the support means receive support, while no lateral forces or moments will be transmitted. This also improves the tonal quality and the ease of operation of the instrument still further.

Moreover, attaching the coupling means adjacent the center between the first and the second ends of the link, and coupling the first and the second link parts by a pivot between the coupling means and the first end of the link offer the advantage of establishing a favorable ratio between the functional length of the second link part between the engagement means and the pivot on the one hand, and the distance between the pivot and the coupling means on the other, which results in a favorable force transmission. Moreover, a central positioning of the coupling means may thus be realized in a simple manner, which simplifies a symmetrical force transmission.

The invention further relates to a percussion instrument, in particular a kettledrum, comprising a device according to the invention.

BRIEF DESCRIPTION OF THE DRAWINGS

To explain the invention, embodiments of a device according to the invention will hereinafter be described in more detail, with reference to the accompanying drawings. In these drawings.

In the drawings, corresponding parts have corresponding reference numerals.

DETAILED DESCRIPTION

Figure 1:
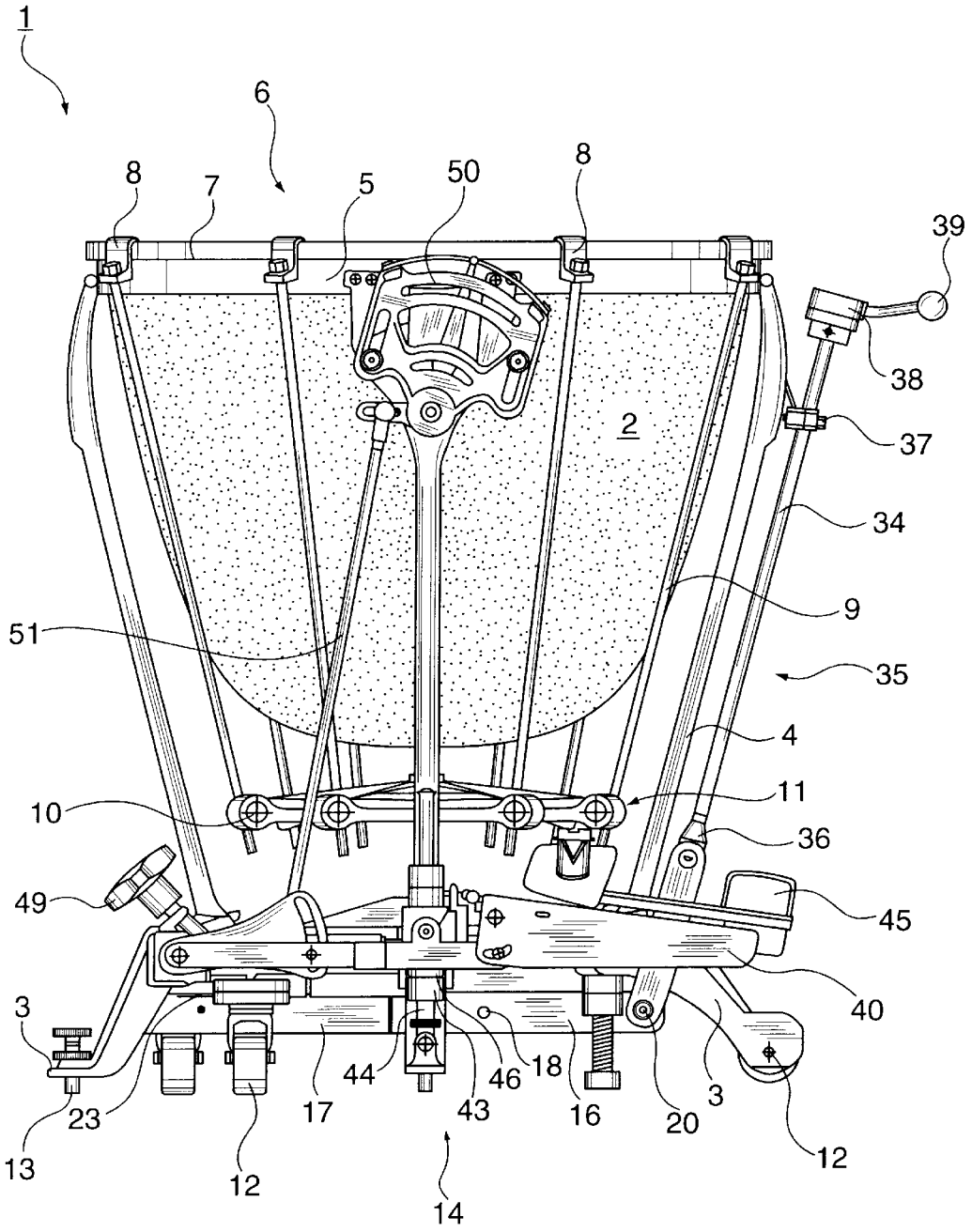
FIG. 1 is a side elevational view of a kettledrum according to the invention.
Figure 2:
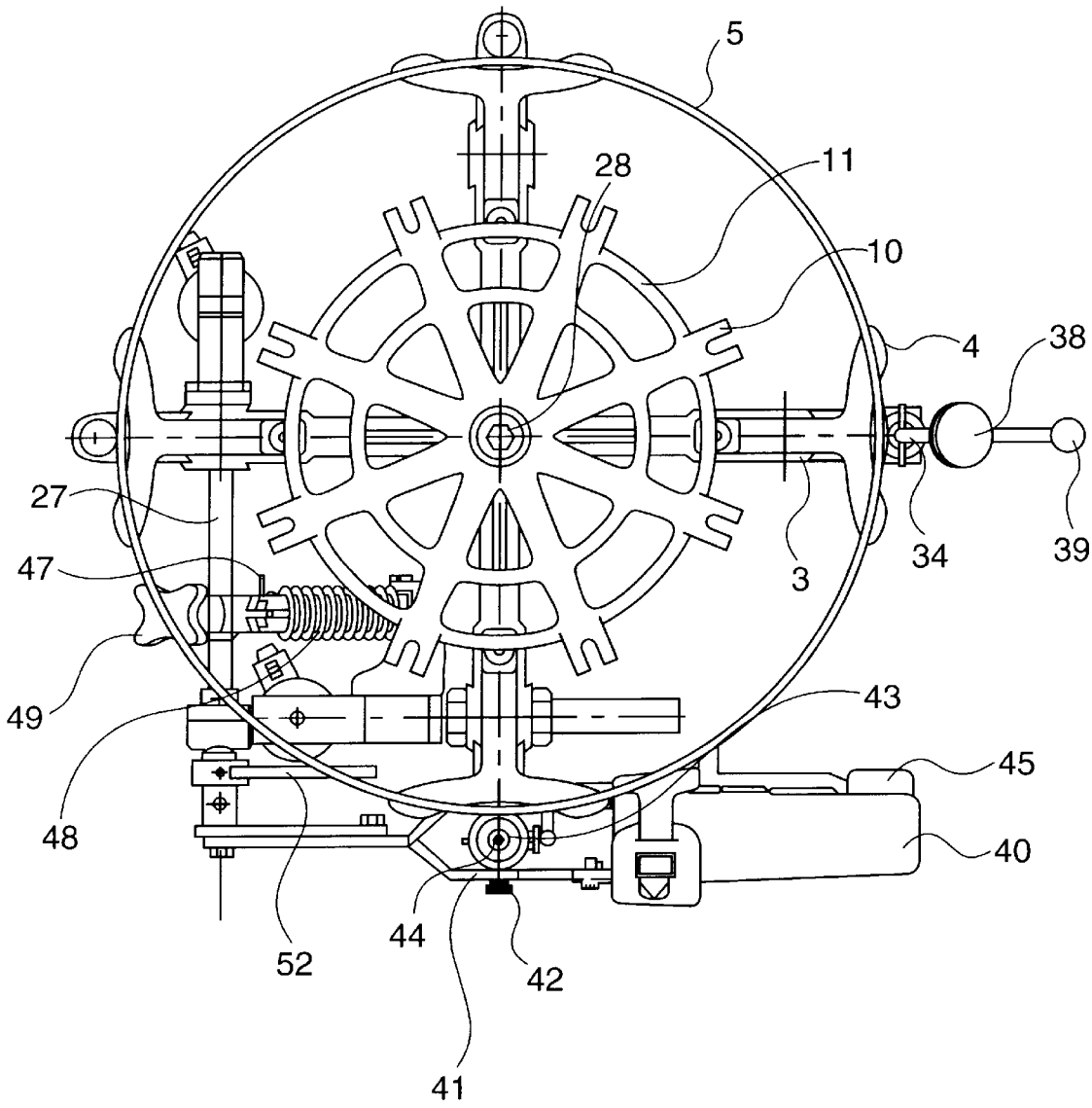
Fig. 2 is a top plan view of a kettledrum according to the invention, with removed skin, kettle and tensioning rods.

The kettledrum 1, as shown in FIG. 1, comprises a kettle 2, supported on a frame 3 via four support rods 4. the support rods 4 have their top ends connected to a hoop 5 within which the kettle 2 can be suspended. The kettle is manufactured from metal and serves as sound box. Over the kettle 2 and the hoop 5, a skin 6 is stretched by means of a tensioning ring 7 provided at the top side along the outside of the hoop 5. By means of clamps 8 and tensioning rods 9 connected thereto and extending along the kettle 2, the tensioning ring 7 is pulled in downward direction, thereby tensioning the skin 6. The bottom ends of the tensioning rods 9 are connected to arms 10 of a tensioning star 11, eight arms (as shown in FIG. 2) in the embodiment shown. As shown in FIG. 1, the ends of the arms 10 comprise setting means capable of cooperating with setting means on the tensioning rods 9 for setting the length thereof, so that all tensioning rods 9 between the clamps 8 and the arms 10 of the tensioning star 11 have equal lengths, as a result of which the tensioning star 11 extends at least substantially horizontally. The frame 3 is supported by three wheels 12 and a blocking support 13, so that the kettledrum 1 can readily be displaced yet can also be positioned in a stable manner.

Figure 4:
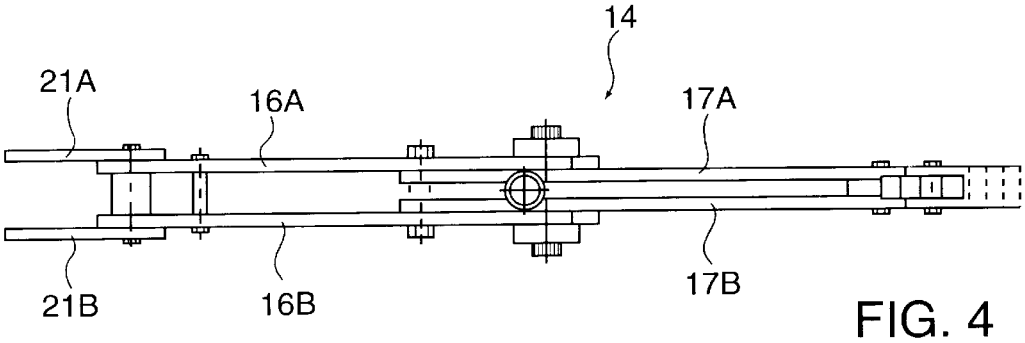
FIG. 4 is a top plan view of an operating device according to FIG. 3.
Figure 3:
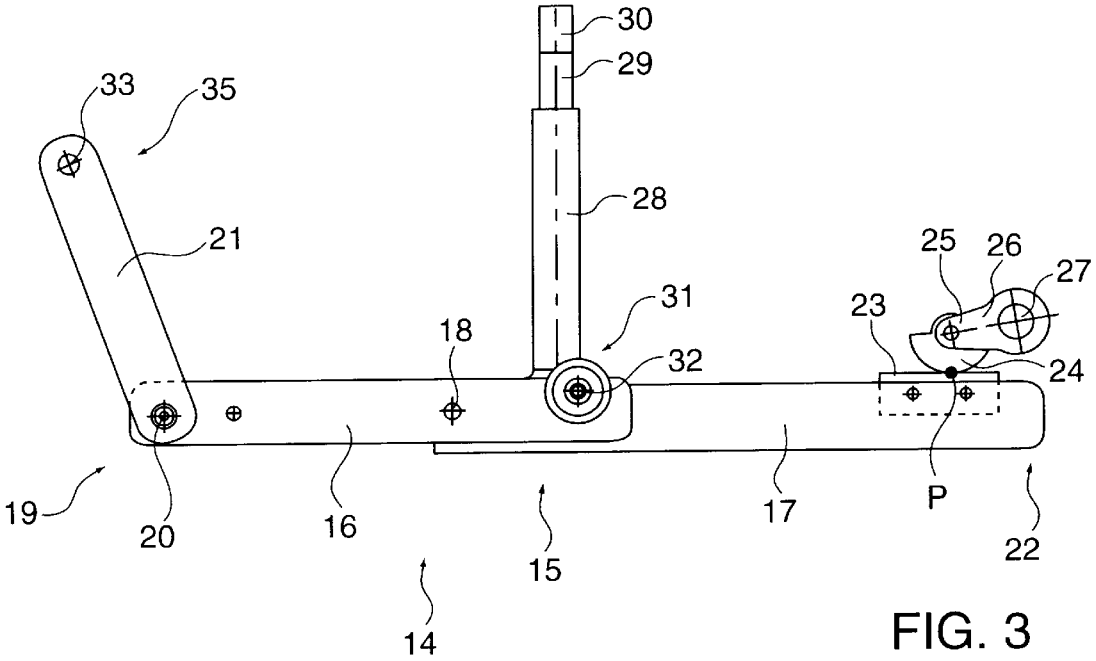
FIG. 3 is a side elevational view of an operating device according to the invention, for use in a kettledrum according to FIGS. 1 and 2.

The tension in the skin 6 can be adjusted through vertical movement of the tensioning ring 11, as the clamps 8 and, accordingly, the tensioning ring 7 to which the skin 6 is connected are thereby moved in vertical direction, pulling the skin 6 more or less taut, depending on the direction of movement of the tensioning star 11. For obtaining a vertical movement of the tensioning star 11, an operating device 14 is provided, as shown in FIGS. 3 and 4. Here, this operating device 14 will be specified first, after which the position and the use thereof in a kettledrum according to FIGS. 1 and 2 will be explained in more detail.

As shown in FIGS. 3 and 4 (to which the reader should simultaneously refer throughout the following discussion), the operating device 14 comprises a link 15, composed of a first link part 16 and a second link part 17, which link parts are bearing-mounted on a pivot 18 for pivoting relative to each other, which pivot, during use, extends approximately horizontally and at right angles to the longitudinal direction of the link 15. In the embodiment shown, the two link parts 16, 17 are manufactured from parallel plate parts 16A, 16B and 17A, 17B respectively, properly spaced apart by suitable sleeves and coupling pins. Adjacent a first end 19 of the link (to the left in FIGS. 3 and 4), a second pivot 20 is provided, which is parallel to the first pivot 18 and pivotally connects a fine-setting arm 21, likewise composed of two parallel plate parts 21A, 21B, to the first link part 16. Adjacent the opposite second end 22 of the link 15, a contact face 23 is provided on the top side of the second link part 17, which can be engaged by an engagement cam 24, which engagement cam 24 is connected to the free end 25 of a tilting cam 26 fixedly connected to an operating axis 27, as will be explained in more detail hereinbelow. Hence, through rotation of the operating axis 27, the tilting cam 26 can be operated, causing the engagement cam 24 to press against the contact face 23 for moving the second end 22 of the link 15 in vertical direction. Approximately halfway between the contact point P between the engagement cam 24 and the contact face 23 on the one hand and the second pivot 20 on the other, a slightly pivotable coupling pin 28 is connected to the second link part 17, which coupling pin, during use, extends approximately in vertical, upward direction. The top end of the coupling pin 28 comprises a reduced portion 29 having screw thread 30 at the free end thereof. The reduced portion 29 can be passed through a central hole in the tensioning star 11, after which the tensioning star 11 can be fixed onto the coupling pin 28 by means of a nut, not shown, fitting the screw thread 30 of the coupling pin 28.

On either side next to the coupling pin 28, a support means 31 in the form of a bearing is provided on the first link part 16, which support means can freely rotate about a rotation axis 32 extending parallel to the first pivot 18 and the second pivot 20. During use, these support means 31 can be supported by a part of the frame 3, in particular by the bottom side of a central part thereof. This means that by the support means 31, substantially only vertical forces can be transmitted, while lateral movements thereof will hardly lead to force transmissions. The coupling pin 28 can move freely between the plate parts 16A and 16B of the first link part 16, to freely enable a vertical movement of the coupling pin 28 relative to the first link part 16.

During use, the tensioning star 11 (see FIG. 1—to facilitate understanding, the reader should also simultaneously refer to this figure along with FIGS. 3 and 4 throughout the ensuing discussion.) is fixedly connected to the top end of the coupling pin 28, as described hereinabove, which will cause the link 15 to be pulled upwards each time, due to the tension in the skin 6, in such a manner that at least the support means 31 abut against the bottom side of a central portion of the frame 3. Adjacent the free end of the fine-setting arm 21, a spindle 34 of fine-setting means 35 is connected thereto, via a third pivot 33 extending parallel to the second pivot 20. For that purpose, the third pivot 33 extends through a pressure cam 36 which, by means of screw thread capable of cooperating with screw thread on the spindle 34, can be moved in the axial direction of the spindle 34 while taking along the fine-setting arm 21. The spindle 34 extends between the plate parts 21A and 21B of the fine-setting arm 21 and has its bottom end accommodated for free rotation in a bearing in the frame 3, in such a manner that axial displacement of the spindle 34 is prevented. Moreover, adjacent the top end of the spindle 34, a bearing 37 is provided, fixedly connected to a hold on one of support rods 4, in which the spindle 34 is freely rotatable. Mounted on the top end of the spindle 34 is a knob 38 having a handle 39 whereby the spindle can be rotated.

Rotation of the spindle 34 results in that the pressure cam 36, as stated, is moved in axial direction of the spindle while taking along the fine-setting arm 21 and hence the second pivot 20. This will involve the first link part 16 pivoting about the rotation axis 32 of the support means 31 so that the first pivot 18 will be moved up or down, depending on the direction of rotation of the spindle 34. As a result, the second link part 17 will pivot, approximately around the engagement point between the engagement cam 24 and the contact face 23, while taking along the coupling pin 28 in the same direction as the second pivot 20. Since the support means 31 receive support from a central part of the frame 3 and the second pivot 18 is located closer to the rotation axis 32 than to the second pivot 20, a particularly advantageous force transmission is obtained, enabling fine adjustment of the tension in the skin 6 by means of the fine-setting means 35 in a particularly light and simple, accurate manner, without changing the position of the engagement cam 24. Indeed, the vertical movement of the coupling pin 28 brings about a corresponding vertical movement of the tensioning star 11, with the above-described effect of changing the tension in the skin 6.

Provided on one side of the frame 3 is a foot pedal 40, connected, as shown in FIG. 2, to the operating axis 27 via a rod mechanism 41. Via a tilting axis 42, the rod mechanism 41 is connected, adjacent the center thereof, to a slide bearing 43 capable of moving in vertical direction along a slide axis 44. Extending along the foot pedal 40 is a blocking pedal 45, connected to a blocking mechanism, which will not be further described, whereby the slide bearing 43 can be locked and released relative to the slide rod 44, so that movement of the foot pedal 40 can thereby be blocked or released. The operating axis 27 extends approximately horizontally below the kettle 2, at right angles to the longitudinal direction of the rod mechanism 41, and is bearing-mounted in the frame 3 in a manner known per se. Hence, during use, the operating axis 27 can be rotated about its longitudinal axis by means of the foot pedal, at least after release of the slide bearing 43, so that the tilting cam 26 is moved thereby, while moving the engagement cam 24 in at least vertical direction. If the tilting cam 24 is moved upwards, the second link part 17 will pivot about the first pivot 18, leftwards in FIG. 3, causing the coupling pin 28 to be pulled up under the influence of the tension in the skin 6, which skin tension will hence decrease. If, on the other hand, the engagement cam 24 is moved downwards, the second link part 17 will pivot rightwards in the position shown in FIG. 3, i.e. it will pivot clockwise around the first pivot 18, while taking the coupling pin 28 along downwards, causing the tension in the skin 6 to be increased in the manner described hereinabove and thereby raising the pitch. By means of the blocking pedal 45, the rod mechanism 41 and accordingly the operating axis 27 can be locked in any desired position, whereby the engagement cam 24 can likewise be fixed in any desired position. As under the influence of the tension of the skin, the coupling pin 28 is always biased in vertical, upward direction, a pivotal movement of the second link part 17 will hardly, if at all, influence the position of the first link part 16. Because of the ratio between on the one hand the distance between the first pivot 18 and the longitudinal axis of the coupling pin 28, and on the other hand the distance between the first pivot 18 and the engagement point P between the engagement cam 24 and the contact face 23, a favorable transmission ratio is obtained. The distance between the first pivot 18 and the longitudinal axis of the coupling pin 28 is preferably considerably less than the distance between the first pivot 18 and this engagement point P.

By way of illustration, a number of ratios are given,which should not be construed as being limiting in any way. The distance between the second pivot 20 and the longitudinal axis of the coupling pin 28 is, for instance, half the distance between the second pivot 20 and the engagement point P. The distance between the first pivot 18 and the longitudinal axis of the coupling pin 28 is for instance one-fifth of the distance between the first pivot 18 and the engagement point P, while the distance between the first pivot 18 and the rotation axis 32 of the support means 31 is for instance one-third of the distance between the rotation axis 32 and the second pivot 20. Of course, other ratios may be chosen, depending on the transmission ratios desired and the forces occurring.

Provided between the frame 3 and the operating axis 27 is a setting device 47, comprising a spring 48 whose tension is settable by means of a setting mechanism 49. The resistance of the foot pedal 40 can thereby be set, if so desired, while compensating for the changing skin tension. Arranged on one of the support rods 4 is a tone-indicating device 50, which is operated, via a rod 51, by an arm 52 on the operating axis 27. A change of position of the operating axis 27 effects a tilting of the tone-indicating device 50, so that a pre-set tone, that is to say tension of the skin 6, can be read.

The invention is by no means limited to the embodiments shown in the Figures. Many variations thereto are understood to fall within the framework of the invention.

For instance, instead of the engagement cam 24, a connection between the tilting cam 26 and the second end 22 of the link 15 can be obtained, for instance by a pin extending through slots in the plate parts 17A, 17B of the second link part 17 and the free end 25 of the tilting cam 26, to obtain a fixed, yet sliding coupling between the second link part 17 and the tilting cam 26. Further, the support means 31 may be positioned differently, for instance at some distance from the coupling pin 28, while these means may be designed differently, for instance as slide bearings. Also, the support means may receive support in a different manner, for instance from the tensioning star. Also, a coupling between the link 15 and the tensioning star 11 may be realized in a different manner. Further, all kinds of variations may be applied to the shape and design of, for instance, the kettle, the coupling between the tensioning star and the skin, the tensioning star and the like. Moreover, an operating device according to the invention may be of a multiple design or for instance be used for a different percussion instrument, or, for instance, in measuring apparatus involving the use of tensioned skins. Further, the link parts may be designed differently, for instance as at least partially closed, solid parts, while, moreover, the fine-setting means may be of a different design. The foot pedal may also engage the operating axis via a transmission mechanism. In addition, the spindle may engage the link directly at or adjacent the first end thereof.

These and comparable variations are understood to fall within the framework of the invention.

I claim:

1. A kettledrum having:

(A) a skin; and (B) a device for setting the tension of the skin, the device comprising:

(B1) a multi-part link having first and second opposing ends with a pivot situated therebetween;

(B2) engagement means, situated on the link proximate the second end thereof, which engage with an engagement member;

(B3) holding means which hold the skin onto the kettledrum in such a manner as to apply a variable amount of tension to the skin so as to maintain the skin in a taut manner; and (B4) coupling means connected to both the holding means and to the link, wherein the coupling means is connected to the link at a position intermediate the first and second ends thereof so as to impart, via the holding means, the tension to the skin in an amount determined by a position of at least a first or second separate part of the link relative to a frame of the kettledrum;

(B5) wherein:

(B5a) the link comprises the separate first and second link parts pivotally interconnected to each other by the pivot, each of the first and second link parts having opposing first and second ends, wherein the first end of the first link part and the second end of the second link part respectively form the first and second ends of the link, the pivot being situated on the first and second link parts inward of the second and first ends of the first and second link parts, respectively;

(B5b) the engagement means and the coupling means are attached to the second link part and situated respectively at a first predefined location, along the second link part, and at a second predefined location, along the second link part intermediate the first predefined location and a location of the pivot on the second link part; and (B5c) the second link part is suspended by the pivot and the coupling means.

2. A device for setting the tension of a skin in a musical instrument, the device comprising:

(A) a multi-part link having first and second opposing ends with a pivot situated therebetween;

(B) engagement means, situated on the link proximate the second end thereof, which engage with an engagement member;

(C) holding means which hold the skin onto the instrument in such a manner as to apply a variable amount of tension to the skin so as to maintain the skin in a taut manner; and (D) coupling means connected to both the holding means and to the link, wherein the coupling means is connected to the link at a position intermediate the first and second ends thereof so as to impart, via the holding means, the tension to the skin in an amount determined by a position of at least a first or second separate part of the link relative to a frame of the instrument;

(E) wherein:

(E1) the link comprise the separate first and second link parts pivotally interconnected to each other by the pivot, each of the first and second link parts having opposing first and second ends, wherein the first end of the first link part and the second end of the second link part respectively form the first and second ends of the link, the pivot being situated on the first and second link parts inward of the second and first ends of the first and second link parts, respectively;

(E2) the engagement means and the coupling means are attached to the second link part and situated respectively at a first predefined location, along the second link part, and at a second predefined location, along the second link part intermediate the first predefined location and a location of the pivot on the second link part; and (E3) the second link part is suspended by the pivot and the coupling means.

3. The device recited in claim 2 wherein at least either one of the first and second link parts comprises support means for receiving support from the frame.

4. The device recited in claim 3 wherein the support means is arranged on the first link part and is situated proximate to the second end of the first link part.

5. The device recited in claim 3 wherein the support means is arranged proximate to the coupling means.

6. The device recited in claim 3 wherein the support means is arranged proximate to the second end of the first link part and next to or at a side of the coupling means.

7. The device recited in claim 3 wherein the support means comprise bearing means.

8. The device recited in claim 2 wherein the first end of the first link part is coupled to a fine-setting means.

9. The device recited in claim 2 wherein the coupling means are connected to the link at a position substantially centrally located between the first and second ends of the link, and the pivot is located between the coupling means and the first end of the first link part.

10. The device recited in claim 9 wherein a distance between the pivot and the coupling means is less than a distance between the coupling means and the engagement means and less than a distance between the pivot and the first end of the link.

* * * * *